United States Patent [19]

Brett

[11] 4,291,839

[45] Sep. 29, 1981

[54] VEHICLE RUST-INHIBITING SPRAY GUN WITH LIGHTING MEANS

[76] Inventor: Dennis A. Brett, 9890 College Ave., Indianapolis, Ind. 46280

[21] Appl. No.: 91,467

[22] Filed: Nov. 5, 1979

[51] Int. Cl.[3] ..... B05B 15/00

[52] U.S. Cl. ..... 239/289; 362/96; 362/398

[58] Field of Search ..... 362/96, 398, 119, 120; 239/289, DIG. 14

[56] References Cited

U.S. PATENT DOCUMENTS

| | | | |
|---|---|---|---|
| 1,269,748 | 6/1918 | Root | 362/398 X |
| 1,670,426 | 5/1928 | Weber | 362/96 |
| 2,987,612 | 6/1961 | Haulter | 362/398 |
| 3,784,804 | 1/1974 | Sabatelli | 239/289 X |
| 3,812,340 | 5/1974 | Brandt | 362/96 |

*Primary Examiner*—Richard A. Schacher

*Attorney, Agent, or Firm*—Woodard, Weikart, Emhardt & Naughton

[57] ABSTRACT

A hand-held, rust-inhibiting spray gun with lighting capability, comprising in combination a grippable body portion, a front spray nozzle, a sealant supply line, and a lightweight, directional and adjustable lighting source removably mounted to the gun and directed to fully illuminate the surface receiving the rust-inhibiting application. The lighting source includes a cup housing and socket combination, a magnet attachable to a bracketed bar on the gun, and an insulated electrical connection near the cup housing for permitting its complete and safe removal for replacement or for periodic cleaning of the gun itself. A threaded lens cap including a lens cover and a conically shaped inner reflective surface having an apex opening, screws onto the cup housing and varies the reflective position of the light bulb thereby adjusting the beam concentration directed to the surface being coated.

9 Claims, 4 Drawing Figures

VEHICLE RUST-INHIBITING SPRAY GUN WITH LIGHTING MEANS

BACKGROUND OF THE INVENTION

This invention relates generally to vehicle undercoating and, in particular, to an improved hand-held spray gun incorporating its own directional and adjustable light source.

For over twenty years, service garages have been applying protective rust-inhibiting sealants to the underbodies and hidden surfaces of automobiles and other vehicles. The sealants themselves have generally been viscous, petroleum-based compounds which harden upon application to provide rust and sound resistance for the coated metal surfaces. Today, many varieties of rust-inhibiting compounds are available on the market. These include QUAKER-KOAT marketed by Quaker State Oil Co. of Oil City, Pa., BODY GARD marketed by Body Gard, Inc. of Cleveland, Ohio, MORTEX marketed by Kendall Oil, Inc. of Bradford, Pa., DURA-COAT marketed by Durable Coatings, Inc. of Akron, Ohio, ZIEBART, marketed by Ziebart, Inc. of Warren, Mich., and others.

The preferred method of applying these undercoating sealants is by spraying means using one of two conventional types of hand-held, portable spray guns. The first type is a pressurized air spray gun incorporating both a sealant and an air supply with means for mixing the two to produce a pressurized spray of the sealing compound. The second type is an airless gun in which a single sealant supply is used with the compound being squirted onto the desired surfaces. Both air spray and airless spray guns are common and available on the market, and function well to provide protective coatings on the hidden vehicle surfaces and underbodies.

However, one problem that has plagued the rust-inhibiting industry since its inception is the proper illumination of vehicle underbodies during the spraying procedure. For almost twenty years, the most common method has been for the sprayer to hold the spray gun in one hand and a steel utility light in the other, directing the light at the surface being coated. These "trouble" lights are often heavy and require long cords making them both cumbersome and tiring to use. They also require a 120 volt service which can be dangerous in the work/spray area because of the presence of hazardous cleaning or other compounds. Accordingly, many garages have at moments employed one man to hold the light while another does the spraying. Still other garages have permitted sprayers to hang a "trouble" light to the underbody itself; but this practice is both annoying and very dangerous, and lacks the directional illumination needed for effective underbody spraying.

Applicant is aware that still other garages have installed expensive light structures either along the floor, walls or the ceiling, or all, employing some means of reflecting light to the vehicle underbodies. However, the expense of such structures is often prohibitive, and their effect substantially more dangerous than is required to accomplish the spraying application.

Therefore, the need has been and remains for a simple, safe, durable, and portable light source for use in the vehicle rust-inhibiting industry. It should be inexpensive, provide little or no danger from its voltage requirements, and have both directional and adjustable capability to provide light at the precise area of spray. It should further do these things efficiently, conveniently, and safely. Applicant is aware of no such device disclosed to or available in the art prior to his present invention.

SUMMARY OF THE INVENTION

One embodiment of applicant's invention comprises a hand-held rust-inhibiting spray gun combining the features of a grippable portion, triggering means for applying the rust-inhibiting compound to the under and hidden surfaces of a vehicle, and lighting means removably mounted to the gun and directed to illuminate the particular surface receiving the rust-inhibiting sealant. In this way, applicant's embodiment provides the convenience and directional capability not previously available in the rust-inhibiting industry.

In the preferred mode of practicing this embodiment, a beam-concentrating means is provided to adjust the dispersal of light from the lighting source to thereby vary the surface area being illuminated. This is accomplished by a durable reflective light unit being magnetically and portably attached to a metal bar bracketed on the gun frame. A snap-in electrical connector near the unit permits its simple removal for replacement or for permitting the periodic cleaning of the spray gun. The unit itself includes a metal housing containing the light bulb and a lens cap screwably attached thereto with a conically shaped inner reflective surface. Adjusting the position of this cap on the cup housing varies the position of the light bulb at the converging end of the conically shaped surface thereby adjusting the light between a concentrated beam for pinpoint illumination and a widely dispersed beam for illuminating larger areas of a vehicle underbody receiving the rust-inhibiting application.

Related objects and advantages of the present invention will be apparent from the following description.

DESCRIPTION OF THE PREFERRED EMBODIMENTS

Figure 1:
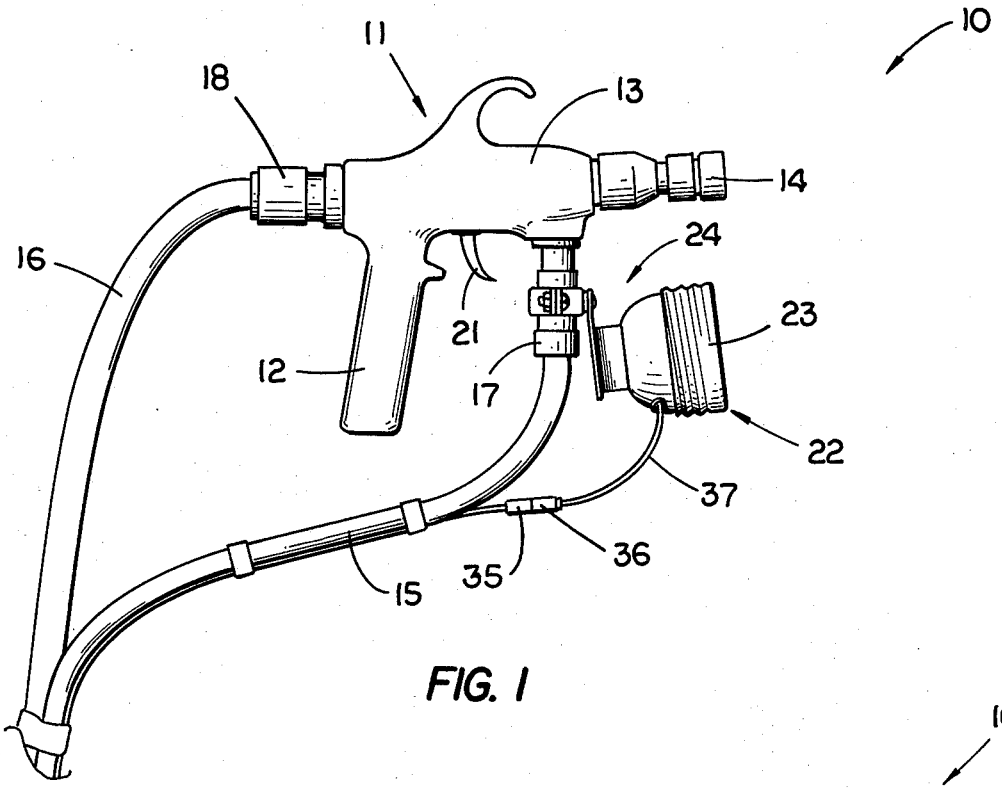
FIG. 1 is a reduced side elevational view of the pressurized air spray gun comprising the preferred embodiment of applicant's invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 2:
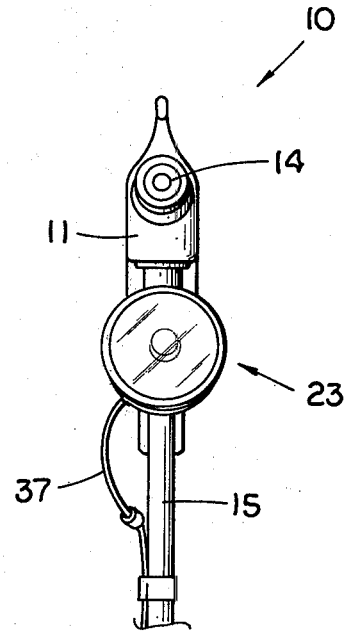
FIG. 2 is a front elevational view of the spray gun depicted in FIG. 1.
Figure 3:
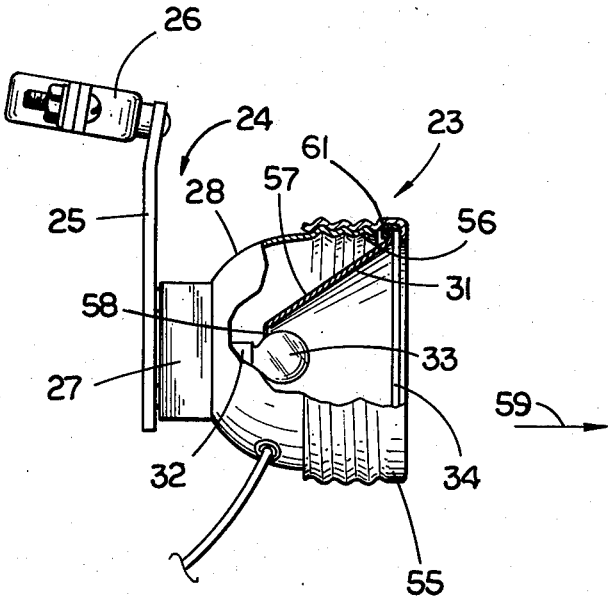
FIG. 3 is an enlarged side elevational view of applicant's preferred light unit and bracket means depicted in FIG. 1.

Referring now to FIGS. 1–3, therein is depicted the pressurized air spray gun 10 comprising the preferred embodiment of applicant's invention. Gun 10 consists of a frame 11 including a grippable portion 12, a body portion 13, and a front spray nozzle or adapter 14. It includes both a sealant supply line 15 and a pressurized air supply line 16 attached to gun 10 by means of pressure fittings 17 and 18, respectively. It further includes conventional means (not shown) inside the journalled body portion 13 for properly mixing the sealant and air supplies for applying the sealant to the under and hidden surfaces of a vehicle, such as an automobile. This means for mixing and for spraying the rust-inhibiting sealant is activated by depressing trigger 21.

In applicant's preferred embodiment, gun 10 is further equipped with a directional and adjustable lighting source 22 for illuminating the direct area of spray application effectively, safely, and without the inconvenience experienced with prior art methods. Lighting source 22 consists of a lighting unit or device 23 removably mounted by some means 24 to gun 10 and directed to illuminate the surface receiving the rust-inhibiting sealant. Although several means of attachment are possible, applicant's preferred means 24 consists of a metal bar 25 attached to the gun by means of bracket 26 with a magnet 27 mounted to the back of the lighting unit for magnetically attaching to this metal bar.

Applicant's preferred lighting unit 23 consists of a cup-shaped housing 28 with an inner reflective surface 31. A light socket 32 is positioned in the back of the housing and receives a light bulb 33 which provides the needed illumination. Because of the possible danger of using a higher voltage in the work/spray area, applicant's preferred lighting source 22 requires only a low 12-volt service which is easily supplied by connection to any conventional 12-volt battery (not shown) or by using a conventional 12-volt transformer (not shown) in connection with a standard electrical wall outlet (also not shown). A removable, transparent lens cover 34 is held against the front of cup housing 28 to permit light diffusion and provide at least some protection against damage to the inner socket and bulb.

Lighting unit 23 further has a beam-concentrating capability for adjusting the dispersal of light from the unit to vary the surface area being illuminated. This feature can be of significant advantage as, for example, in general automotive rust-inhibiting where the worker must at one point spray the whole vehicle underbody while at a later point spray the innermost reaches under fenders and inside wheel wells and door cavities. Nevertheless, this feature has never before been available in the industry to applicant's knowledge.

Although various beam-concentrating means can be used equally well with applicant's lighting device, preferred unit 23 is equipped with a tubular-shaped lens cap 55 that is screwably attached to a threaded outer portion 56 on cup housing 28. Retaining ring 61 holds lens cover 34 in position and also secures a conically shaped inner portion 57 which reflects the light from its inner reflective surface 31. Portion 57 includes an opening 58 at its inner apex and is designed to position bulb 33 at various points relative to the reflective surface in response to cap 55 being screwed onto or off threaded portion 56 of the housing. By so doing, differing beam concentrations are obtained depending upon the position of bulb 33 relative to the reflective surface, all according to known laws of physics and mathematics.

For example, in FIG. 3 cap 55 is screwed as far as possible onto housing 28. Bulb 33 is thereby positioned far inside portion 57 and the result is a widely dispersed light beam suitable for general underbody spraying. If cap 55 is unscrewed in the direction of arrow 59 in FIG. 3, a point will be reached where the relative position of bulb 33 with respect to reflective surface 31 produces a concentrated beam for pinpoint illumination of hard-to-see areas such as inner door panels and wheel wells. The ease and simplicity of adjusting the beam concentration with lighting unit 23 are major advantages of applicant's invention because of the great versatility it provides the worker.

At periodic intervals, all spray guns require cleaning to remove built-up sealant and film from their inner working parts. The common method of such cleaning is to place the entire gun in a container of solvent for at least 20 minutes to accomplish the necessary cleaning. As the flash point of such solvents may be sufficiently low to risk ignition by an electrical spark, it is important that even applicant's 12 volt service not come in contact with the solvent material. To accomplish this, applicant employs a male and female insulated connector 35 and 36, respectively, in its electrical line 37 near lighting source 22. When preferred gun 10 requires cleaning, or when direct lighting is not required, this insulated connection is simply disjoined and the magnetic attachment broken thereby removing the light source 22 and permitting the gun's further use or its full immersion in the solvent bath without fear of an electrical spark. When cleaning is completed, male connector 35 is simply dried of solvent before reattaching the lighting source.

With regard to material and part selection, much variation is accorded with applicant's invention. As to gun 10, several pressurized air spray guns are now available on the market and work equally well in applicant's invention. Preferred gun 10 is an Air Spray Binks 351 model marketed by the Binks Manufacturing Company. As to lighting source 22, the important considerations in material selection are durability, safety and weight. It is possible that an entire plastic unit 22 could be constructed from a material such as a polycarbonate. Applicant's preferred unit, however, is constructed from a lightweight chrome-plated steel with a glass lens cover 34.

Figure 4:
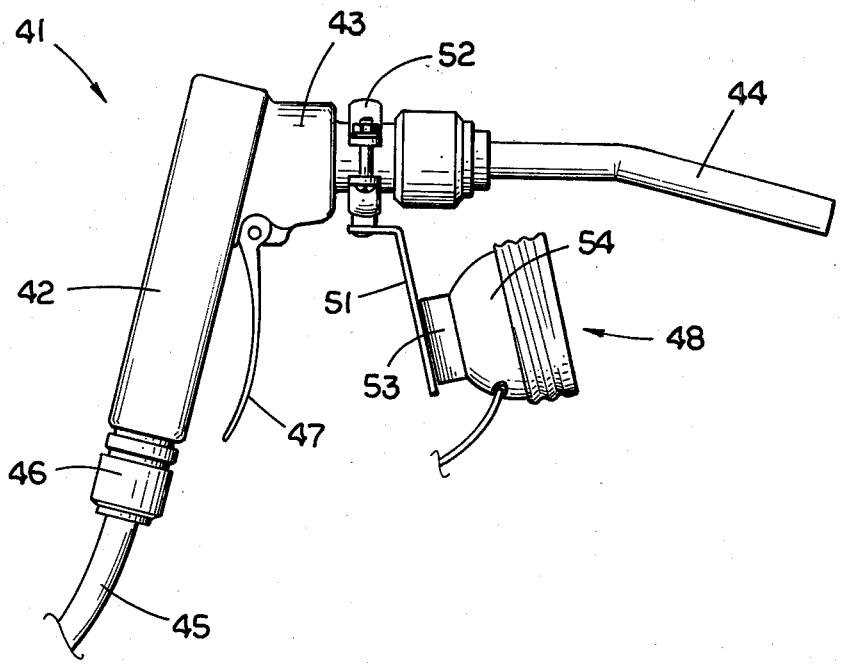
FIG. 4 is a side elevational view of an airless spray gun comprising a second embodiment of applicant's invention.

Referring now to FIG. 4, therein is depicted an airless spray gun 41 comprising a second embodiment of applicant's invention. Gun 41 again incorporates a grippable portion 42 and body portion 43 with a front spray nozzle 44. A sealant supply line 45 and pressure fitting 46 are attached to the bottom of grippable portion 42, but no pressurized air supply line is required. Instead, rust-inhibiting sealant is applied directly to the underbody and hidden surfaces of a vehicle in a pumping or spraying action by activating trigger 47.

Applicant's gun 41 is also equipped with its own directional and adjustable lighting source 48 identical to source 22 previously described. Attachment of lighting source 48 is again accomplished by means of a metal bar 51, bracket 52, and magnet 53 attached to the back of cup housing 54. As above, lighting source 48 provides lightweight, directional illumination of the spray area safely and without the inconvenience or annoyance of prior art illuminating methods and devices. It also provides simple and easy adjustment of the beam concentration to accommodate normal underbody coating as well as tight, hard-to-see areas where a more concentrated beam is required.

As to material and part selection, applicant's preferred airless gun 41 is a ARO AIRLESS marketed by Aro Manufacturing Company. Lighting source 48 is identical to source 22 and is accordingly subject to the same variation and modification.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim:

1. A hand-held, rust-inhibiting spray gun, comprising in combination:

(a) a grippable portion;

(b) a triggering means for applying rust-inhibiting sealant to the under and hidden surfaces of a vehicle; and (c) a lighting means removably mounted thereto and directed to illuminate the surface receiving the rust-inhibiting application, said lighting means includes an illuminating device, said device comprising:

(1) a cup-shaped housing;

(2) a socket position within said housing for receiving a lighting bulb therein;

(3) electrical means for illuminating said bulb;

(4) magnetic means secured to the back of said housing for removably attaching said housing to the spray gun;

(5) a lens cover removably attached to said housing; and (6) an inner reflective surface for directing the light beam to illuminate the surface receiving the rust-inhibiting application.

2. The spray gun of claim 1 additionally comprising a beam-concentrating means for adjusting the dispersal of light from said lighting means to vary the surface illuminated thereby, said means being adjustable between a concentrated beam for pinpoint illumination and a widely dispersed beam for illuminating a large surface receiving the rust-inhibiting application.

3. The spray gun of claim 2 in which said lens cover is held within a tubular-shaped cap screwably attached to a threaded outer portion of said cup housing, said inner reflective surface being conically shaped and having an inner apex opening for positioning the lighting bulb therein, said beam-concentrating means including said inner reflective surface being movable with said cap to vary the position of the bulb within said opening thereby adjusting the dispersal of light reflected from said surface.

4. The spray gun of claim 3 additionally comprising a metal bar bracketed to the gun and extending therefrom, said magnetic means of said illuminating device being removably attachable to said metal bar.

5. The spray gun of claim 4 in which said electrical means includes a female and a male insulated connector for safe and easy removal of said illuminating device.

6. The spray gun of claim 5 in which said electrical means includes a 12 volt transformer.

7. The spray gun of claim 6 in which said means for applying employs air pressure.

8. The spray gun of claim 6 in which said means for applying employs no air pressure.

9. The spray gun of claim 3 in which said cup housing and said cap are metal and said lens cover is glass.

* * * * *